US006161771A

United States Patent [19]

Henry

[11] Patent Number: 6,161,771

[45] Date of Patent: Dec. 19, 2000

[54] WATER FOUNTAIN SYSTEM AND METHOD

[75] Inventor: Jeffery W. Henry, New Braunfels, Tex.

[73] Assignee: Water Ride Concepts, Inc., New Braunfels, Tex.

[21] Appl. No.: 08/862,215

[22] Filed: May 23, 1997

[51] Int. Cl.[7] ..... B05B 17/08

[52] U.S. Cl. ..... 239/17; 239/18; 239/222.11; 239/233

[58] Field of Search ..... 239/16, 17, 222.11, 239/222.17, 225.1, 230–3, 461, 500, 18

[56] References Cited

U.S. PATENT DOCUMENTS

| | | | |
|---|---|---|---|
| 2,888,205 | 5/1959 | Trucco | 239/124 |
| 3,598,402 | 8/1971 | Frenzl . | |
| 4,205,785 | 6/1980 | Stanley | 239/17 |
| 4,376,404 | 3/1983 | Haddad | 239/18 |
| 4,545,583 | 10/1985 | Pearman et al. . | |
| 4,564,190 | 1/1986 | Frenzl . | |
| 4,792,260 | 12/1988 | Sauerbier . | |
| 4,905,987 | 3/1990 | Frenzi . | |
| 4,954,014 | 9/1990 | Sauerbier et al. . | |
| 5,011,134 | 4/1991 | Langford . | |
| 5,020,465 | 6/1991 | Langford . | |
| 5,022,588 | 6/1991 | Haase | 239/222.17 |
| 5,069,387 | 12/1991 | Alba | 239/18 |
| 5,143,107 | 9/1992 | Kelley | 239/276 |
| 5,152,210 | 10/1992 | Chen | 239/18 |
| 5,171,101 | 12/1992 | Sauerbier et al. . | |
| 5,194,048 | 3/1993 | Briggs . | |
| 5,213,547 | 5/1993 | Lochtefeld . | |
| 5,224,652 | 7/1993 | Kessler | 239/222.19 |
| 5,230,662 | 7/1993 | Langford . | |
| 5,236,280 | 8/1993 | Lochtefeld . | |
| 5,271,692 | 12/1993 | Lochtefeld . | |
| 5,393,170 | 2/1995 | Lochtefeld . | |
| 5,401,117 | 3/1995 | Lochtefeld . | |
| 5,421,782 | 6/1995 | Lochtefeld . | |
| 5,437,463 | 8/1995 | Fromm . | |
| 5,439,170 | 8/1995 | Dach | 239/18 |
| 5,453,054 | 9/1995 | Langford . | |
| 5,503,597 | 4/1996 | Lochtefeld et al. . | |
| 5,564,859 | 10/1996 | Lochtefeld . | |
| 5,628,584 | 5/1997 | Lochtefeld . | |
| 5,664,910 | 9/1997 | Lochtefeld et al. . | |
| 5,667,445 | 9/1997 | Lochtefeld . | |
| 5,738,590 | 4/1998 | Lochtefeld . | |
| 5,766,082 | 6/1998 | Lochtefeld et al. . | |
| 5,779,553 | 7/1998 | Langford . | |

*Primary Examiner*—Andres Kashnikow
*Assistant Examiner*—Lisa Ann Douglas
*Attorney, Agent, or Firm*—Conley, Rose & Tayon

[57] ABSTRACT

System and method for rotating a roof with water to create a participatory water attraction. The system preferably includes a roof having a friction surface and a support member for supporting the roof. A first conduit may be used to direct water onto the friction surface to cause the roof to rotate in a clockwise direction, and a second conduit may be used to direct water onto the friction surface to cause the roof to rotate in a counterclockwise direction. A valve is preferably used to direct water into one of the first and second conduits while restricting water flow into the other conduit. The valve preferably is adjustable by a participant at ground level. The friction surface preferably includes a plurality of protrusions to facilitate rotation of the roof by providing a contact area for the water directed at the roof. A control system may be used to activate a light system and/or a sound system when the valve is adjusted.

210 Claims, 9 Drawing Sheets

WATER FOUNTAIN SYSTEM AND METHOD

BACKGROUND OF THE INVENTION

1. Field of the Invention

The present invention generally relates to water amusement attractions and rides. More particularly, the invention relates to a water fountain system and method in which participants may be actively involved in operating the water fountain system.

2. Description of the Related Art

Water recreation facilities have become a popular form of entertainment in the past few decades. Conventional water attractions at amusement parks typically involve using gravity to make water rides work, or they involve spraying water to create a fountain. The water rides that use gravity typically involve water flowing from a high elevation to a low elevation along a water ride surface. These gravity induced rides are generally costly to construct, and they usually have a relatively short ride time. Conventional fountains in water parks are generally passive attractions for people because guests of the parks usually cannot control the water flow in these fountains.

One water attraction that allows guests to become more actively involved with water spraying objects is described fully in U.S. Pat. No. 5,194,048 to Briggs. This attraction relates to an endoskeletal or exoskeletal participatory water play structure whereupon participants can manipulate valves to cause controllable changes in water effects that issue from various water forming devices.

SUMMARY OF THE INVENTION

In accordance with the present invention, a water fountain system is provided which is a participatory water play system. The water fountain system preferably has the operational ability to allow changes to water effects by the physical act of manipulating a valve or valves. The water fountain system preferably includes sound and/or light displays that are controllable by physical acts of a participant. Furthermore, the water fountain system may teach participants, especially children, the cause and effect relationship between action (turning a valve) and reaction (water jets causing a roof to spin).

An embodiment of the water fountain system of the present invention includes a roof having a friction surface. The roof preferably has the ability to rotate about a vertical axis when a jet of water hits the friction surface. The friction surface preferably contains a plurality of protrusions (e.g., rib-like members, indentions, protruding structures) providing a contact surface for receiving the water. The water fountain system preferably includes a support member connected to the roof and to the ground below. A first conduit preferably directs water from a water source to a first nozzle located near the roof. The first nozzle may direct a jet of water in a first direction toward the roof to cause the roof to rotate in a substantially clockwise direction. A second conduit preferably directs water to a second nozzle also located near the roof. The second nozzle may then direct a jet of water in a second direction toward the roof to cause the roof to rotate in a substantially counterclockwise direction.

A diverter valve may be disposed upstream from the first conduit and the second conduit. The diverter valve may direct water to one of the first or second conduits while restricting water flow through the other conduit. The valve is preferably located near the ground so that it may be adjusted by a participant. It may also be located near the roof, and in this case, a control system may be coupled (e.g., electrically, mechanically, or pneumatically) to the valve. The control system may be manipulated by a participant to operate the valve from the ground. Operation of the valve may cause activation of the sound and/or lighting system.

BRIEF DESCRIPTION OF THE DRAWINGS

Other objects and advantages of the invention will become apparent upon reading the following detailed description and upon reference to the accompanying drawings in which.

Figure 1:
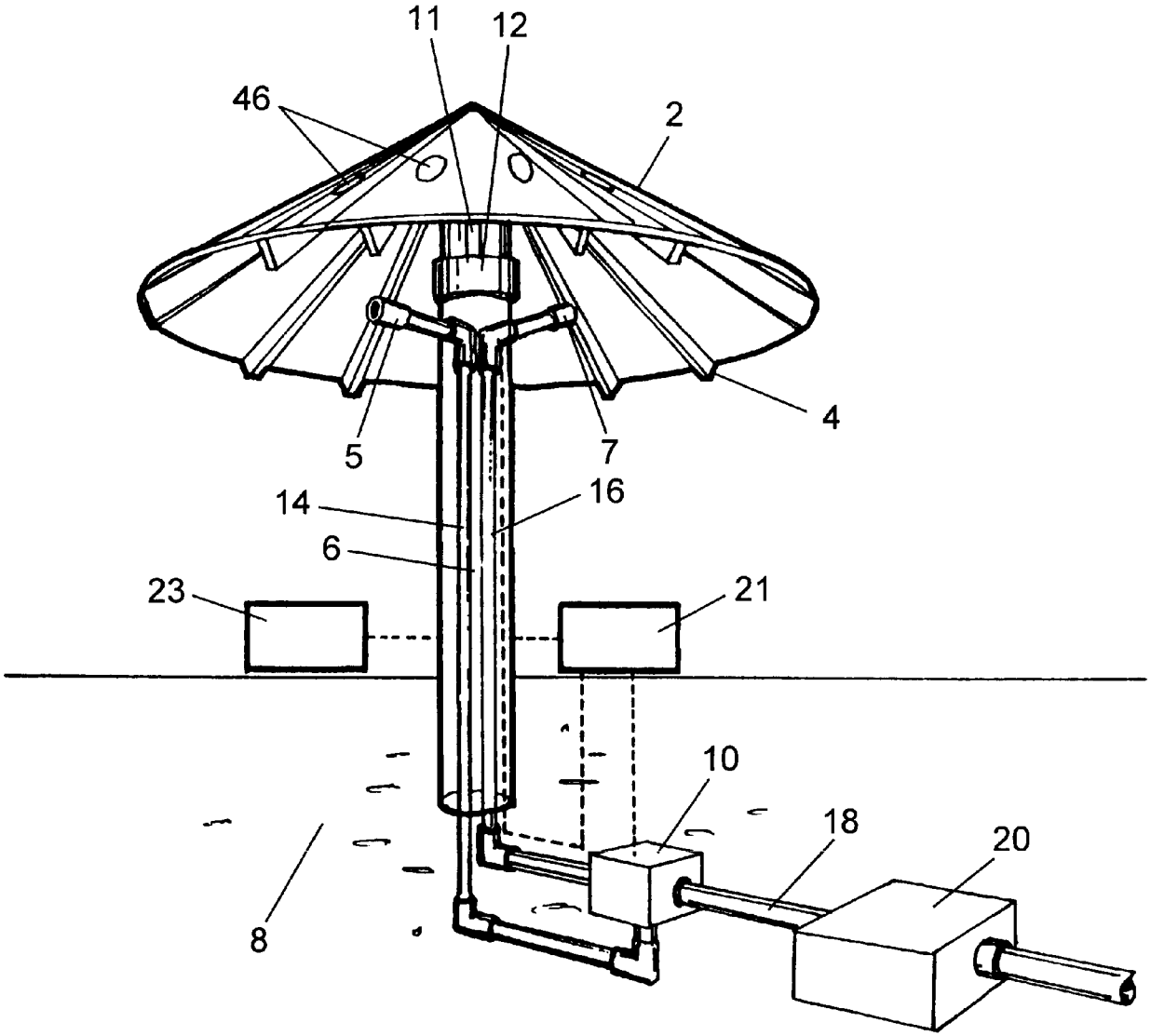
FIG. 1 is a cross-sectional plan view of one embodiment of a water fountain system having an exoskeletal support member.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to FIG. 1, one embodiment of a water fountain system for participatory play is illustrated. The water fountain system preferably includes a roof 2 which may have protruding members or protrusions 4 attached to its lower surface. A bearing 12 preferably allows roof 2 to rotate about a substantially vertical axis. Bearing 12 can instead be a bushing. Roof 2 preferably includes a lip 11 which may be a cylindrically-shaped shell. Lip 11 preferably extends vertically from the bottom of roof 2. Lip 11 is preferably seated within bearing 12 and may rotate in a substantially clockwise direction or a substantially counterclockwise direction. The rotation of lip 11 is facilitated because there is preferably little or no friction between the outer surface of lip 11 and the inner portion of bearing 12. In an alternate embodiment, lip 11 contains a bearing on its inner surface that substantially surrounds the upper end of support member 6.

An elongated support member 6 preferably supports roof 2, and support member 6 preferably extends from reservoir 8 to roof bearing 12. Reservoir 8 preferably holds water used in the water fountain system. As depicted in FIG. 1, support member 6 may be an "exoskeletal" support member whereby a first conduit 14 and a second conduit 16 are mounted to support member 6 for conveying water to roof 2. A first nozzle 5 is preferably attached to first conduit 14, and a second nozzle 7 is preferably attached to second conduit 16. First nozzle 5 may direct a jet of water to the lower surface of roof 2 such that roof 2 rotates about support member 6 in a clockwise direction (as viewed from above roof 2). Second nozzle 7 may direct a jet of water to another portion of the lower surface of roof 2 such that roof 2 rotates in a counterclockwise direction (as viewed from above roof 2).

As described herein, a "protrusion" is taken to mean any feature located on the roof that is adapted to increase friction between the roof and water that is directed toward the roof. Protrusions 4 may cause the surface of the roof to be uneven. Protrusions 4 may be protruding structures or indented portions of the roof that facilitate rotation of the roof by providing a contact surface for water directed at the roof. Protrusions 4 are preferably rib-like support members. As described herein, a "friction surface" is taken to mean an upper and/or lower surface of roof 2 that is adapted to be contacted by water to cause rotation of the roof. The friction surface preferably contains protrusions 4.

A third conduit 18 is preferably connected to first conduit 14 and second conduit 16 to supply water to the first and second conduits. Valve 10 is preferably located at a junction where the third conduit is attached to the first and second conduits. Valve 10 is preferably a diverter valve which controls water flow to either first conduit 14 or second conduit 16. Valve 10 preferably has a handle which may be turned to control the direction of water flow. Valve 10 may be located at any point on or before nozzles 5 and/or 7. Third conduit 18 preferably extends into reservoir 8 to a location below the water level in the reservoir. Pump 20 is preferably disposed within third conduit 18 to force water from the reservoir through the conduits. If valve 10 is adjusted to direct water from third conduit 18 to first conduit 14, water is preferably pumped to nozzle 5. Nozzle 5 then preferably directs a jet of water in a first direction at the bottom of roof 2, which causes the roof to rotate in a clockwise direction. If instead valve 10 is adjusted to direct water to second conduit 16, nozzle 7 preferably directs a jet of water in a second direction to the bottom of roof 2. This jet of water preferably causes roof 2 to rotate in a counterclockwise direction. When water hits roof 2, it is preferably directed off in droplets to create a visual fountain effect. The water preferably passes from the roof back into reservoir 8 so that it may be recycled through the water fountain system.

In any of the embodiments described herein, "nozzle 5" and "nozzle 7" may each include multiple nozzles.

As described herein, a "roof" is taken to mean any member capable of rotating in response to being contacted by a jet of water. Roof 2 is preferably composed of fiberglass, but it may also be made out of metal, plastic, or any other suitable material. Roof 2 may be substantially flat or it may be non-planar. Roof 2 may have a shape that resembles a figure such as, for example, a square, a circle, a triangle, a cone, a sphere, an umbrella, a pyramid, an animal, an insect, a plant, a dinosaur, a space ship, an inner tube, a boat, an auto, an airplane, etc. First conduit 14, second conduit 16, and third conduit 18 may be made of, for example, PVC, polyethylene, or galvanized steel pipes.

Figure 2:
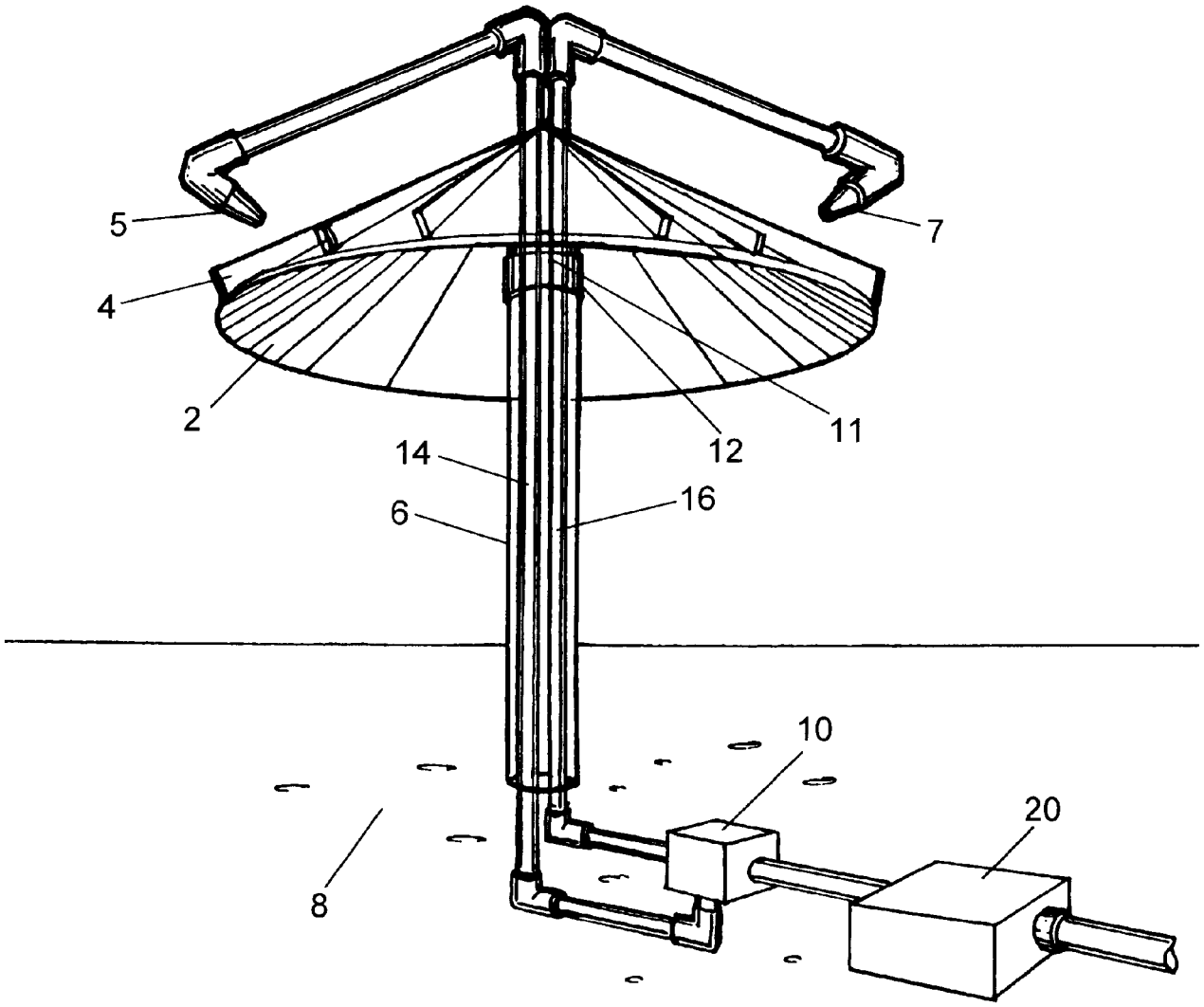
FIG. 2 is a cross-sectional plan view of one embodiment of a water fountain system having an exoskeletal support member.

Turning to FIG. 2, another embodiment is presented which is similar to the embodiment of FIG. 1. The water fountain system preferably includes the same components as the water fountain system mentioned above. However, first conduit 14 and second conduit 16 preferably extend upwardly through an opening in roof 2 so that the nozzles are positioned above roof 2. The opening in roof 2 is preferably located substantially in the center of lip 11. First nozzle 5 may then direct water in a first direction at the upper surface of roof 2 to cause roof 2 to rotate in a clockwise direction. Roof 2 may have protrusions 4 located on its upper surface to create a friction surface for receiving water. Second nozzle 5 may direct water at the upper surface of roof 2 in a second direction to cause roof 2 to rotate in a counterclockwise direction. First and second nozzles 5 and 7 may be located at any point of the conduits 14 and 16 (e.g., near the center of roof 2, near the edge of roof 2, or any point therebetween).

Figure 3:
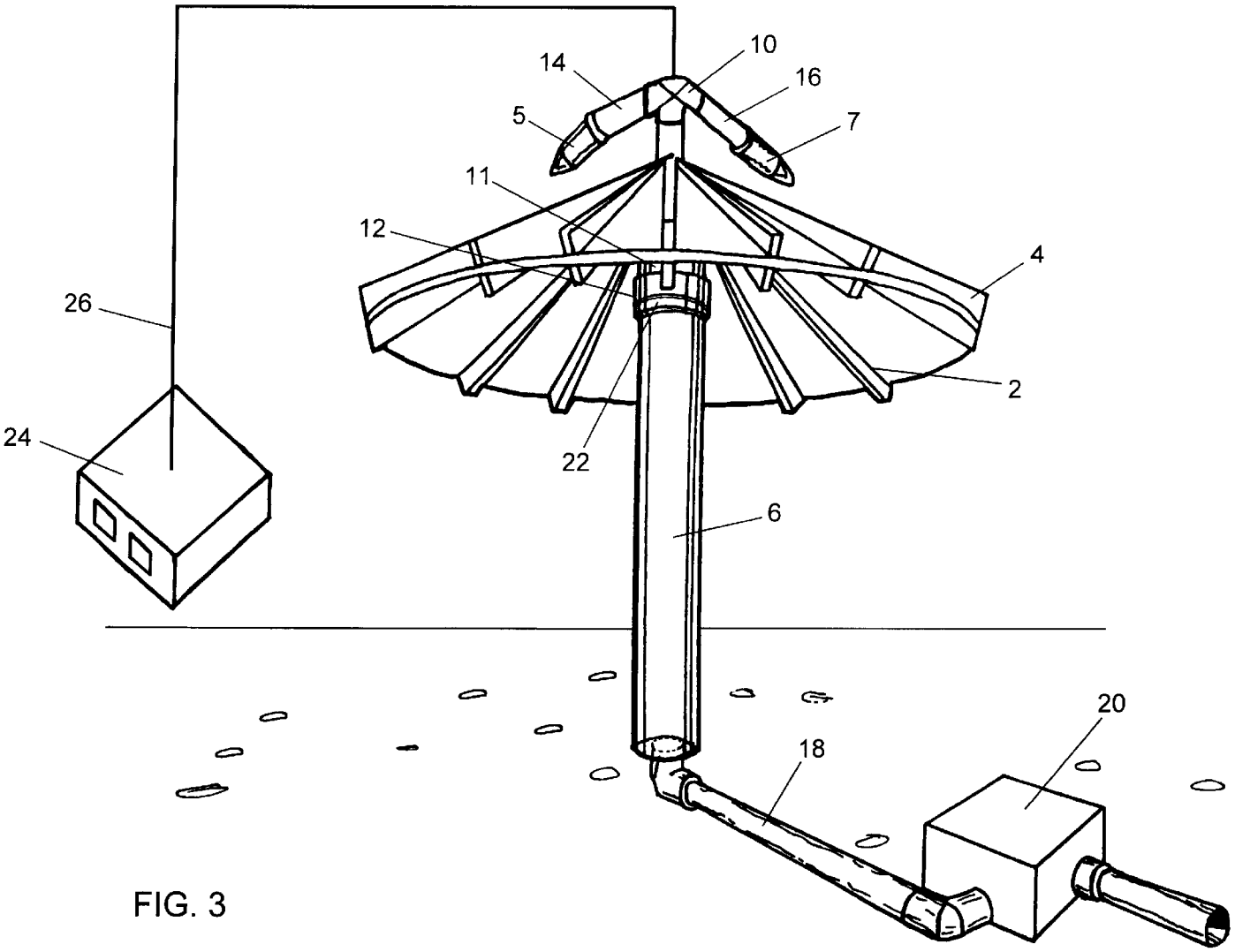
FIG. 3 is a cross-sectional plan view of one embodiment of a water fountain system having an endoskeletal support member.

FIG. 3 depicts an embodiment of a water fountain system in which support member 6 is an "endoskeletal" support member. An "endoskeletal" support member is one which serves as both a support member and a conduit for passing water to roof 2. In FIG. 3, support member 6 coincides with a portion of third conduit 18. Third conduit 18 preferably extends upwardly through an opening in the roof located inside of lip 11. A ring 22 is preferably attached about third conduit 18 underneath bearing 12 to mount bearing 12 to third conduit 18. Valve 10, first conduit 14, second conduit 16, first nozzle 5, and second nozzle 7 are preferably located above roof 2. Protrusions 4 may be located on the upper surface of roof 2 to form a friction surface at which water may be directed to cause roof 2 to spin. Components of this embodiment preferably perform the same functions as previously discussed. However, valve 10 is preferably controlled from the ground using a control system 24. Control system 24 may be operated electrically, mechanically, or pneumatically. Signal lines 26 that preferably contain electrical signals or air may connect valve 10 to control system 24. Such signal lines 26 may pass through or outside of support member 6. Control system 24 may be controlled by simply depressing buttons to cause water to flow through either first conduit 14 or second conduit 16.

Figure 4:
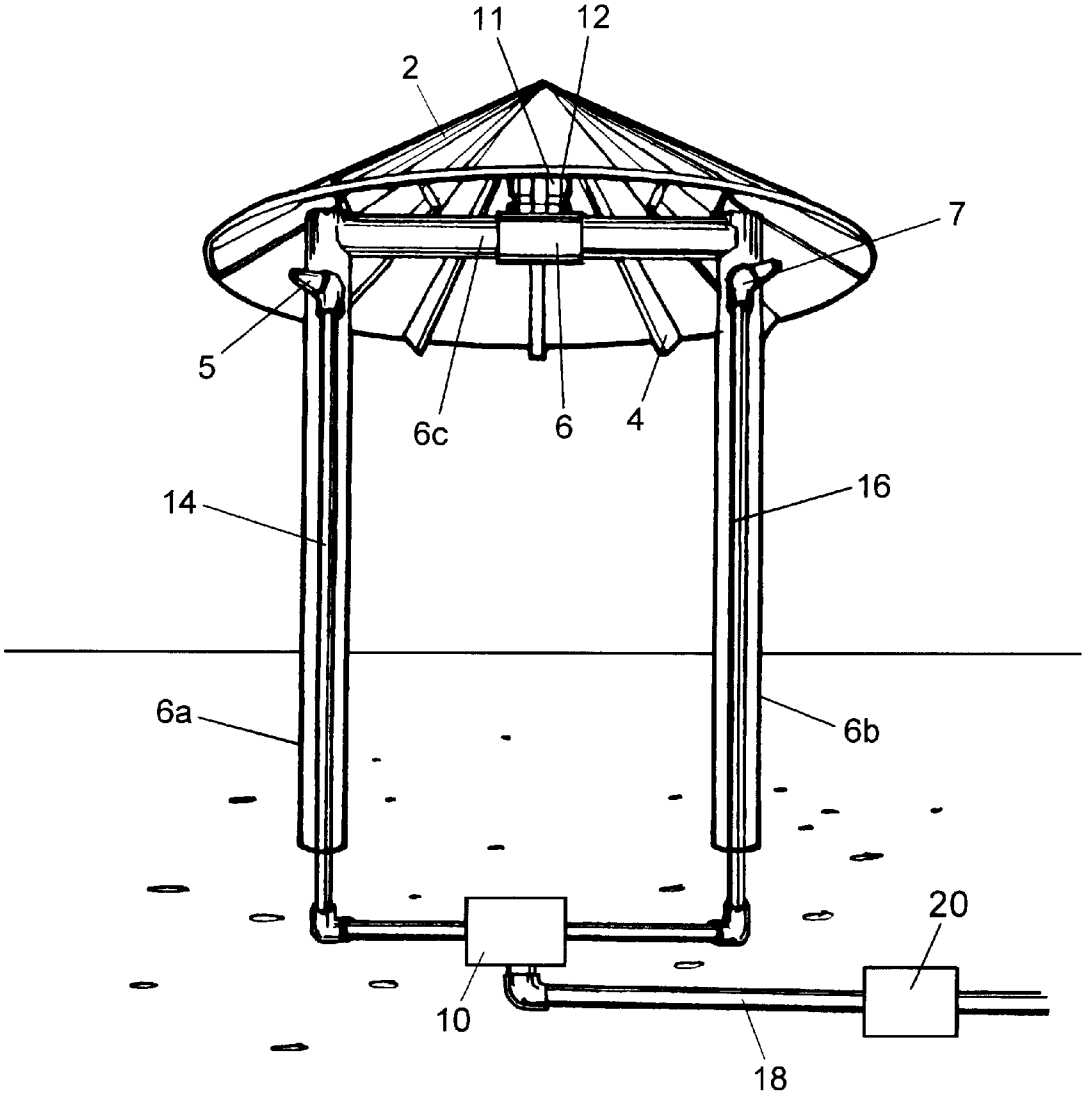
FIG. 4 is a cross-sectional plan view of one embodiment of a water fountain system having an exoskeletal support member.

FIG. 4 illustrates another embodiment of a water fountain system in which support member 6 is an exoskeletal support member. All of the components of this embodiment preferably have the same functions as previously discussed. Support member 6 preferably has three members. First member **6*a* and second member 6*b* are preferably substantially parallel to one another. They are preferably connected to reservoir 8 at their bottom ends. They preferably extend upwardly to an elevational level below roof 2. Third member 6*c* preferably connects the upper end of first member 6*a* to the upper end of second member 6*b*. Third member 6*c* is preferably substantially perpendicular to members 6*a* and 6*b*. Third member 6*c* is preferably connected to bearing 12. First conduit 14 is preferably mounted to first member 6*a*, and first nozzle 5 is preferably connected to first conduit 14 near the upper end of first member 6*a*. Second conduit 16 is preferably mounted to second member 6***b*, and second nozzle 7 is preferably connected to second conduit 14 near the upper end of second member 6*b*. Roof 2 may have protrusions 4 located on its lower surface to form a friction surface thereon. Third conduit 18 preferably extends from within the water of reservoir 8 to valve 10. Valve 10 may include a handle which may be adjusted to direct water flow to either first conduit 14 or second conduit 16. Valve 10 and its handle are preferably located near ground level to allow participants on the ground to adjust the handle.

Figure 5:
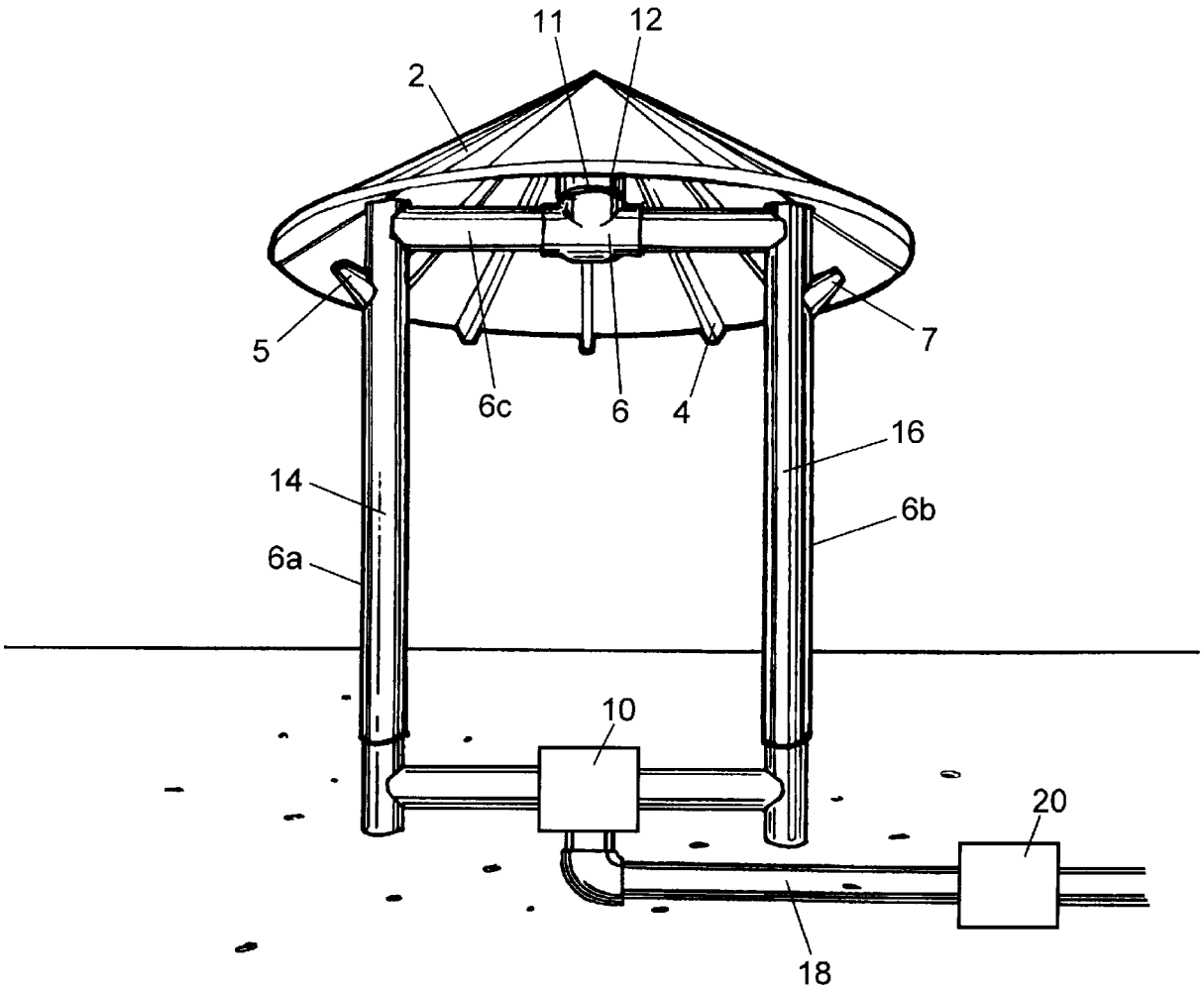
FIG. 5 is a cross-sectional plan view of one embodiment of a water fountain system having an endoskeletal support member.

FIG. 5 depicts another embodiment of a water fountain system in which support member 6 is an endoskeletal support member. Support member 6 preferably has three members arranged as in FIG. 4 and discussed above. First member 6*a*, however, preferably forms a portion of first conduit 14. That is, water may pass through a section of first member 6*a*. First conduit 14 preferably extends from first member 6*a* toward the roof so that first nozzle 5 may direct water to the lower surface of roof 2. Furthermore, second member 6*b* preferably forms a portion of second conduit 16. Second conduit 16 may extend toward roof 2 from second member 6*b* so that second nozzle 7 can direct water toward the lower surface of the roof. Protrusions 4 may be located on the bottom of roof 2 to form a friction service for receiving water to cause roof 2 to rotate. In this embodiment, valve 10 is preferably located near the ground and may be adjusted by turning a handle.

Figure 6:
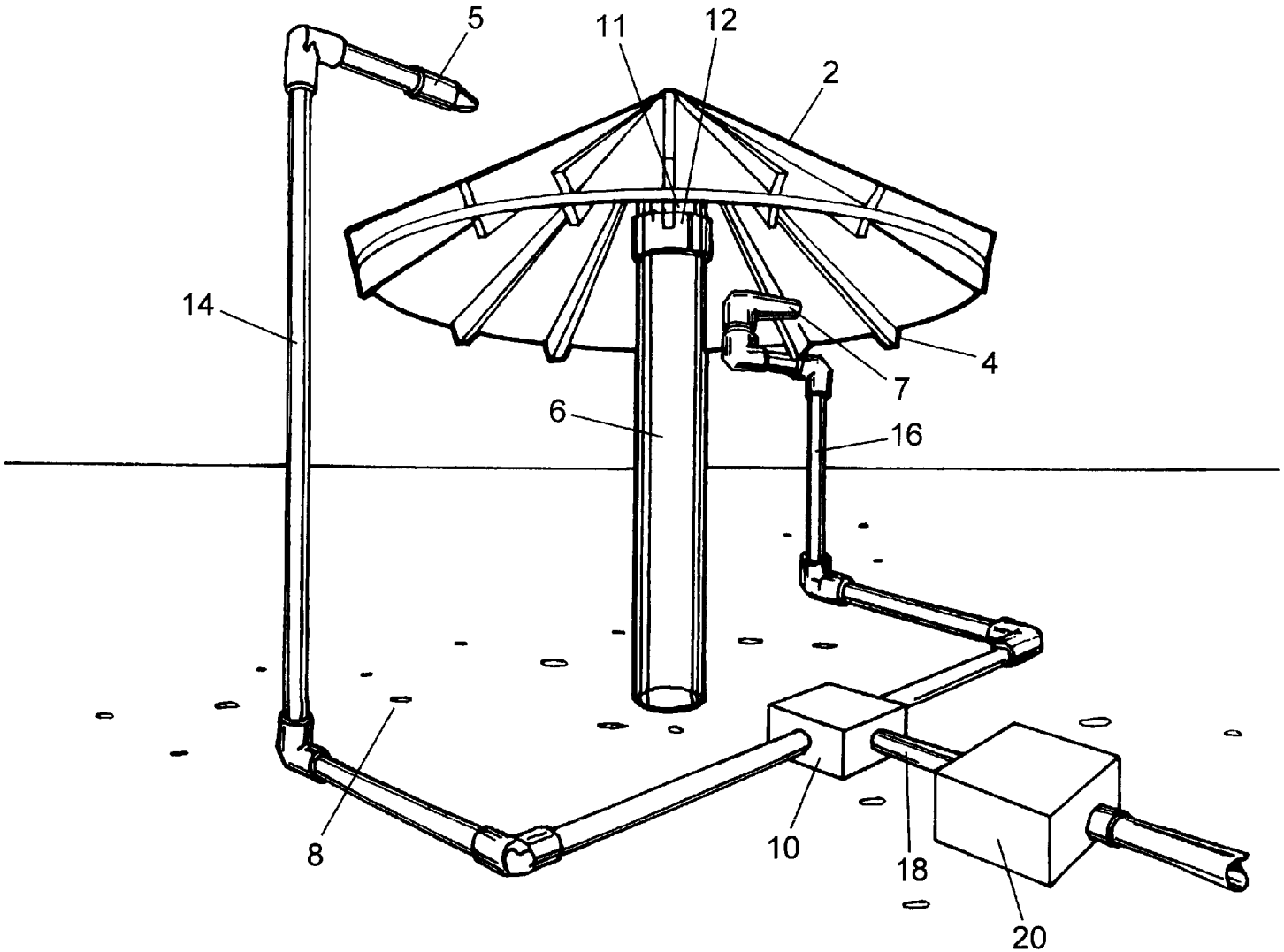
FIG. 6 is a cross-sectional plan view of one embodiment of a water fountain system having an exoskeletal support member.

FIG. 6 depicts an embodiment of a water fountain system in which support member 6 is an exoskeletal support member. The components of the water fountain system preferably have the same functions as discussed previously. Conduits 14 and 16 may be separated from support member 6. Protrusions 4 may be located on both the upper surface and the lower surface of roof 2 to form a friction surface on both the top and the bottom of roof 2. Conduits 14 and 16 preferably extend upwardly on opposite sides of support member 6 to carry water to the roof. Conduit 14 may extend to an elevational level above roof 2 so that nozzle 5 may direct water at the top of roof 2. Conduit 16 may extend to an elevational level underneath roof 2 so that nozzle 7 may direct water at the bottom of roof 2. Nozzles 5 and 7 may be positioned to simultaneously direct water at the roof to rotate the roof in one direction. In an alternate embodiment, nozzles 5 and 7 direct water toward the roof at different times, whereby nozzle 5 is positioned to cause the roof to rotate in either a clockwise or counterclockwise direction, and nozzle 7 is positioned to cause the roof to rotate in a direction opposite to the rotational direction when nozzle 5 is used.

Figure 7:
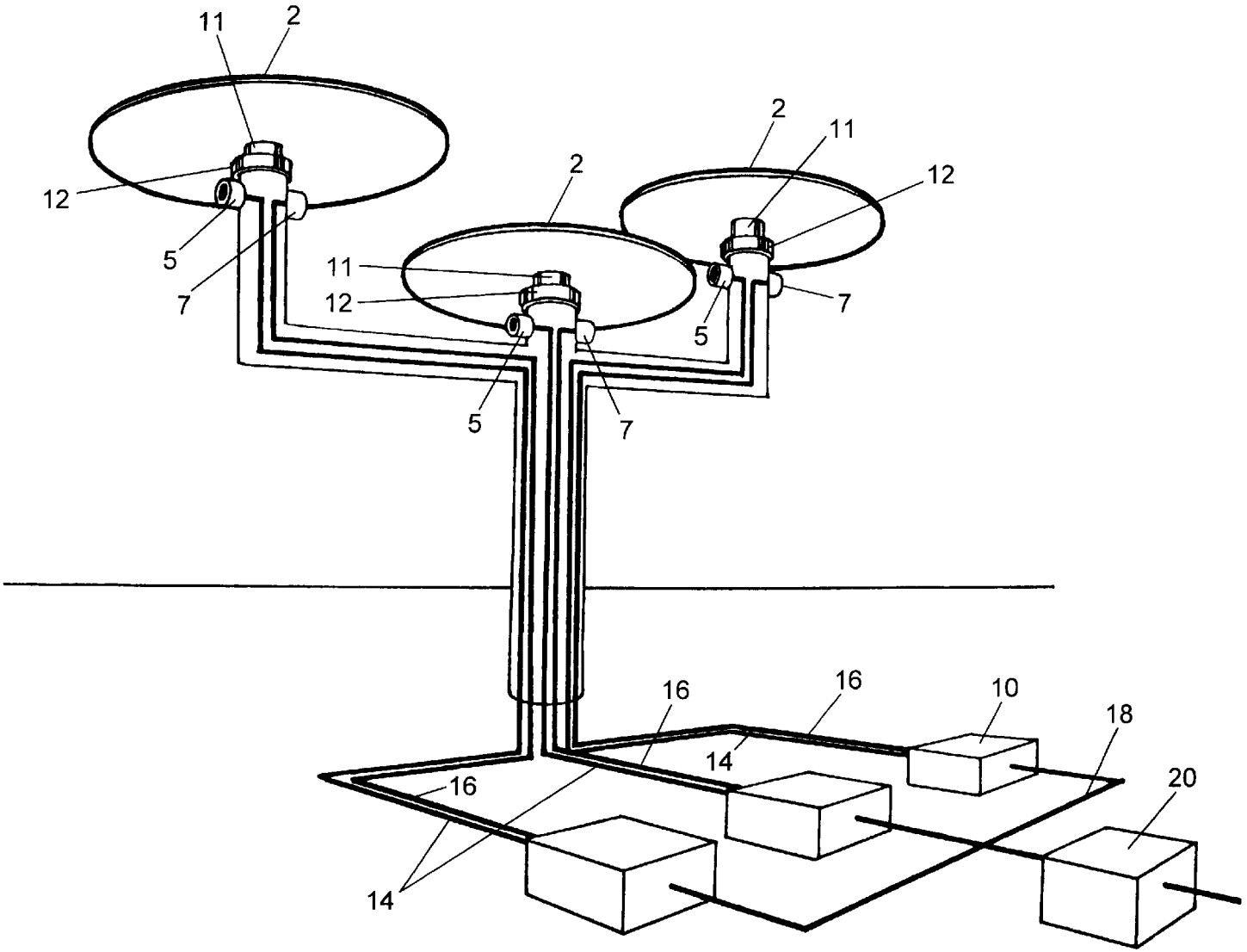
FIG. 7 is a cross-sectional plan view of one embodiment of a water fountain system having a plurality of roofs.

FIG. 7 depicts an embodiment of a water fountain system having a plurality of rotatable roofs 2. Roofs 2 may have any of many different shapes. However, when they are spaced very close together (e.g., stacked on top of one another), roofs 2 preferably have a substantially flat shape to prevent them from contacting each other upon rotating. They may also have protrusions 4 on their upper and/or lower surfaces to form friction surfaces thereon. The water fountain system preferably includes a plurality of conduits, a plurality of nozzles, and a plurality of valves. A pump 20 preferably pumps water from reservoir 8 to three valves 10 via conduits 18. Each valve 10 is preferably adjusted to either direct water through conduit 14 or conduit 16. Water is preferably directed to each roof 2 via either nozzle 5 or nozzle 7. Each nozzle 5 may direct a jet of water to its respective roof 2 such that roof 2 rotates in a clockwise direction. Each nozzle 7 may direct a jet of water to its respective roof 2 such that roof 2 rotates in a counterclockwise direction. Bearings 12 and lips 11 of roofs 2 preferably enable roofs 2 to spin.

Figure 8:
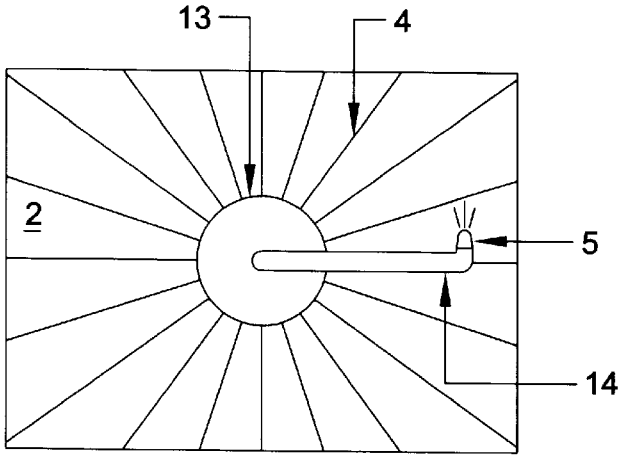
FIG. 8 depicts a top view of an embodiment of a water fountain system that includes a roof having members protruding from its surface.
Figure 9:
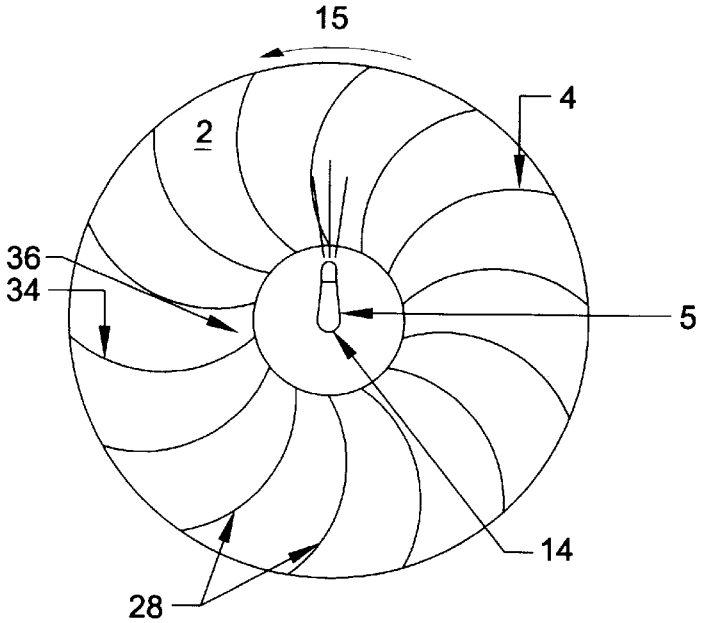
FIG. 9 depicts a top view of an embodiment of a water fountain system that includes a roof having curved members protruding from its surface.
Figure 10:
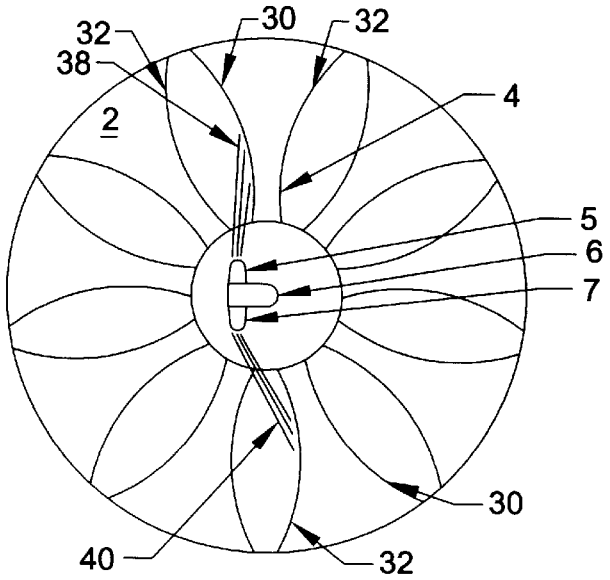
FIG. 10 depicts a top view of an alternate embodiment of a water fountain system that includes a roof having curved members protruding from its surface.

The top views of various embodiments of roof 2 are depicted in FIGS. 8–10. The protrusions 4 may be ribs that radially extend from central portion 13 of roof 2. The ribs preferably include a contact surface that is raised from the surface of the roof. Although not shown in FIGS. 8–10, lip 11 is preferably located within or about central portion 13. It is to be understood that protrusions 4 may be disposed on both the top surface and the bottom surface of roof 2, depending upon the position of nozzles 5 and 7. The top view of the roof is shown in FIGS. 8–10 for convenience.

Referring to FIG. 8, conduit 14 may extend from central portion 13 toward the outer edge of roof 2 to allow water to be directed from nozzle 5 to the radially-outward portions of protrusions 4 to substantially maximize the torque applied to the roof. The water preferably impinges upon the contact surface of the protrusions 4 at a substantially perpendicular angle.

Referring to FIG. 9, the roof may contain a plurality of ribs having curved portions 28 radially disposed about the roof. The curved portions are preferably curved in a direction opposite of the rotational direction 15 of the roof. In this manner, nozzle 5 may direct water toward the ribs from a location in the vicinity of central portion 13. The water preferably contacts at least a portion of the curved portions 28 at a substantially perpendicular angle to cause the roof to rotate.

Referring to FIG. 10, each radially disposed rib may contain a pair of complementary curved portions 30 and 32 that extend toward the edge of the roof in diverging directions. The curved portions 30 and 32 are preferably located about the outer edge of the roof. Portion 30 is preferably curved in a direction to allow the roof to rotate in a clockwise direction upon being contacted with a jet of water directed from nozzle 5. Portion 32 is preferably curved in a direction to allow the roof to rotate in a counterclockwise direction upon being contacted with a jet of water directed from nozzle 7.

As shown in FIG. 10, nozzle 5 may be offset from the center of central portion 13 and angled to direct water substantially along flow path 38 toward curved portion 30 to rotate the roof in a clockwise direction (as viewed from above). Flow path 38 is preferably substantially parallel to the radially-outward portion of curved portion 32 to inhibit any water directed from nozzle 5 that contacts curved portions 32 from producing a significant torque in the counterclockwise direction. Likewise, nozzle 7 may be offset from the center of central portion 13 and angled to direct water substantially along flow path 40 toward curved portions 32 to rotate the roof in a counterclockwise direction (as viewed from above). Flow path 40 is preferably substantially parallel to the radially-outward portion of curved portions 30 to inhibit any water directed from nozzle 7 that contacts curved portion 30 from producing a significant torque in the clockwise direction.

The radially-inward portions 36 of protrusions 4 may have a lower height than the radially-outward portions 34. In this manner, the radially-inward portions tend not to block water directed at the radially-outward portions from the nozzle(s). Alternately, the nozzles may be positioned above or below the roof and angled to direct water above or below the radially-inward portions so that it may reach the radially outward portions. Alternately, the radially-inward portions may be absent.

In all of the embodiments described herein, nozzles 5 and 7 may be directionally adjustable so that the water directed from such nozzles may be directed in different directions without having to alter the positions of conduits 14 and 16. The nozzles may be directionally adjusted manually or with a control system that is electrically, pneumatically or manually operated. In an embodiment, the water fountain system includes a single nozzle that may be adjusted to direct water towards roof 2 in at least two directions such that the nozzle can cause the roof to be rotated in a clockwise or counterclockwise direction. The nozzle is preferably adjustable using a control system so that a participant proximate ground level can change the direction from which water is directed at the roof.

Figure 11:
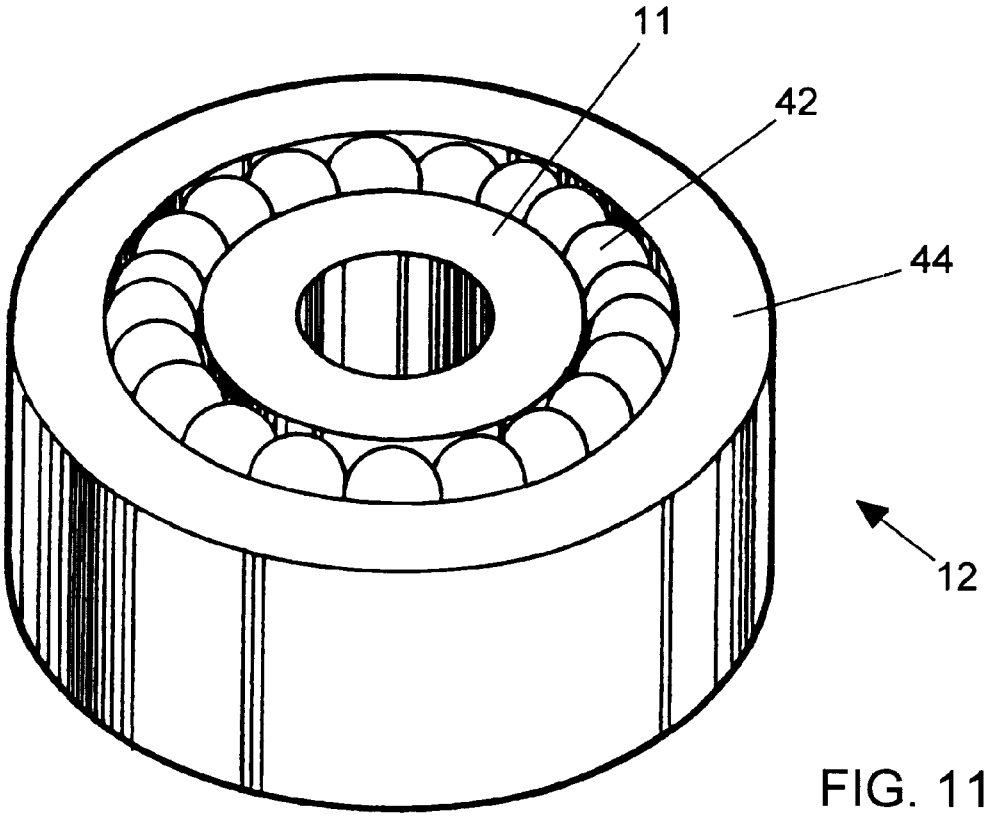
FIG. 11 is a cross-sectional plan view along a horizontal plane of a bearing of a water fountain system.

FIG. 11 illustrates a horizontal cross-section of bearing 12. Lip 11 of roof 2 is preferably a cylindrical shell seated within bearing 12. Its outer surface preferably contacts spinnable objects 42. These spinnable objects 42 may be in the form of balls or drums encased within a race 44. Race 44 preferably surrounds spinnable objects 42. When a jet of water hits roof 2 at an angle, lip 11 preferably rotates since objects 42 may rotate as lip 11 rotates. Little or no friction preferably exists between spinnable objects 42 and lip 11. In another embodiment, a bushing may be used instead of a bearing. In such an embodiment, the inner surface of the bushing is preferably lubricated to reduce friction between the bushing and the lip.

In an embodiment, the support member 6 may be shaped to resemble a figure such as, for example, a square, a circle, a triangle, a cone, a sphere, an umbrella, a pyramid, an animal, an insect, a plant, a dinosaur, a space ship, an inner tube, a boat, an auto, and or airplane. The sound system may be adapted to play sound effects that relate to the figures represented by the roof 2 and/or support member 6. For example, the support member 6 may have the shape of a dinosaur, and the sound system may be capable of producing sounds that would tend to be made by a dinosaur. Likewise, the roof may have the shape of, for example, a boat, car, or airplane, and the sound system may be capable of producing sounds generated by boats, cars or airplanes.

Each of the above-described water fountain systems may include a light system and a sound system as illustrated in FIG. 1. The light system preferably includes lights 46 which may be located near or on roof 2. A control system 21 may be electrically coupled to the lights. In an embodiment, control system 24 includes a computer for transmitting and receiving electrical signals for coordinating operation of one or more valves 10, the lighting system, and the sound system. Control system 21 may turn different lights 46 and/or the sound system on and off randomly or at predetermined times. The control system 21 may open and close valve 10 randomly or at predetermined times. Alternately, control system 21 may activate the lights in response to valve 10 being automatically or manually adjusted. Control system 21 may also be connected to a sound system 23 located near the water fountain system. Adjustment of valve 10 may cause sound system 23 to be activated. Upon activation, the sound system may play music, or may only make a sound effect. For example it may play a whistle sound, animal sound, horn sound, etc. Alternately, sound system 23 may play music or sound effects at predetermined times so that the adjustment of valve 10 is not required for the sound system to be activated.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A water fountain system, comprising:

a roof having a friction surface;

a support member adapted to be connected to the roof to support the roof such that the roof is capable of rotating during use;

a first conduit adapted to be positioned to direct water toward the friction surface in a first direction to cause the roof to rotate in a first rotational direction during use;

a second conduit adapted to be positioned to direct water toward the friction surface in a second direction to cause the roof to rotate in a second rotational direction during use;

a water source adapted to supply water to at least one of the first and second conduits during use; and a valve adapted to control water flow through the first and second conduits during use, the valve being adapted to (a) direct water through the first conduit while water flow is restricted through the second conduit during use, and (b) direct water through the second conduit while water flow is restricted through the first conduit during use.

2. The water fountain system of claim 1, wherein the roof is rotatable about a substantially vertical axis.

3. The water fountain system of claim 1, further comprising a nozzle connected to the first conduit, the nozzle being adapted to direct the water toward the friction surface in the first direction.

4. The water fountain system of claim 1, further comprising a first nozzle connected to the first conduit, the first nozzle being adapted to direct the water toward the friction surface in the first direction, and further comprising a second nozzle connected to the second conduit, the second nozzle being adapted to direct the water toward the friction surface in the second direction.

5. The water fountain system of claim 1, further comprising a third conduit communicating with at least one of the first and second conduits, the third conduit being connected to the water source.

6. The water fountain system of claim 1, wherein the valve is manually operable from a location proximate ground level.

7. The water fountain system of claim 1, wherein the friction surface is located on an upper surface of the roof.

8. The water fountain system of claim 1, wherein the friction surface is located on a lower surface of the roof.

9. The water fountain system of claim 1, wherein the roof comprises an upper surface and a lower surface, and wherein the friction surface is located on both the upper surface and the lower surface.

10. The water fountain system of claim 1, further comprising a pump for forcing water from the water source to the roof.

11. The water fountain system of claim 1, wherein the water source is a reservoir, and wherein the support member is attached to the reservoir.

12. The water fountain system of claim 1, further comprising a first nozzle connected to the first conduit, the first nozzle being adapted to direct the water toward the friction surface in the first direction, and further comprising a second nozzle connected to the second conduit, the second nozzle being adapted to direct the water toward the friction surface in the second direction, and wherein the friction surface is located on an upper surface of the roof, and wherein the first nozzle and the second nozzle are located above the roof to direct water towards the friction surface.

13. The water fountain system of claim 1, further comprising a first nozzle connected to the first conduit, the first nozzle being adapted to direct the water toward the friction surface in the first direction, and further comprising a second nozzle connected to the second conduit, the second nozzle being adapted to direct the water toward the friction surface in the second direction, and wherein the friction surface is located on a lower surface of the roof, and wherein the first nozzle and the second nozzle are located below the roof to direct water to the friction surface.

14. The water fountain system of claim 1, further comprising a first nozzle connected to the first conduit, the first nozzle being adapted to direct the water toward the friction surface in the first direction, and further comprising a second nozzle connected to the second conduit, the second nozzle being adapted to direct the water toward the friction surface in the second direction, and wherein the first nozzle is located below the roof and the second nozzle is located above the roof.

15. The water fountain system of claim 1, wherein the friction surface comprises a plurality of radially extending ribs.

16. The water fountain system of claim 1, wherein the friction surface comprises a plurality of protrusions.

17. The water fountain system of claim 1, wherein the support member comprises a bearing for allowing the roof to rotate, and wherein the roof comprises a bottom surface and a lip extending from the bottom surface, the lip being seated within the bearing.

18. The water fountain system of claim 1, wherein the support member comprises a bushing for allowing the roof to rotate, and wherein the roof comprises a bottom surface and a lip extending from the bottom surface, the lip being seated within the bushing.

19. The water fountain system of claim 1, wherein the support member comprises a first section, a second section, and a third section, the first section and the second section extending below the roof in a substantially vertical direction, the third section being connected to the roof and connecting the first section to the second section.

20. The water fountain system of claim 1, wherein the support member extends from the roof to ground level in a substantially vertical direction.

21. The water fountain system of claim 1, wherein the first conduit and the second conduit are mounted to the support member.

22. The water fountain system of claim 1, wherein at least one of the first conduit and the second conduit is disposed within the support member.

23. The water fountain system of claim 1, wherein the first conduit and the second conduit provide structural support for the roof.

24. The water fountain system of claim 1, wherein the support member comprises a third conduit communicating with at least one of the first and second conduits, the third conduit being connected to the water source.

25. The water fountain system of claim 1, wherein the roof has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane.

26. The water fountain system of claim 1, wherein the valve is a diverter valve.

27. The water fountain system of claim 1, wherein the valve is located proximate ground level such that the valve is operable by a participant located at the ground level.

28. The water fountain system of claim 1, wherein the valve is located proximate the roof, and further comprising a control system for controlling the valve, the control system being operable by a participant located at ground level.

29. The water fountain system of claim 1, further comprising a lighting system for displaying lights, and further comprising a control system for operating the lighting system.

30. The water fountain system of claim 1, further comprising a sound system for creating musical sounds, and further comprising a control system for operating the sound system.

31. The water fountain system of claim 1, wherein the friction surface comprises a plurality of ribs extending radially from a central portion of the roof, the ribs comprising a curved portion for receiving the water directed from the first conduit.

32. The water fountain system of claim 1, wherein the friction surface comprises a plurality of ribs extending radially from a central portion of the roof, the ribs comprising a first curved portion for receiving the water directed from the first conduit, the ribs comprising a second curved portion for receiving the water directed from the second conduit, the first curved portion and the second curved portion extending in diverging directions.

33. The water fountain system of claim 1, wherein the roof further comprises an opening, and wherein the first conduit extends through the opening above the roof.

34. The water fountain system of claim 1, wherein the support member has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane, and further comprising a sound system adapted to generate sound effects during use that correspond to the figure.

35. The water fountain system of claim 1, wherein the first conduit comprises a first nozzle for directing the water, and wherein the second conduit comprises a second nozzle for directing the water, and wherein the first and second nozzles are directionally adjustable.

36. The water fountain system of claim 1, further comprising a first nozzle connected to the first conduit, the first nozzle being adapted to direct the water toward the friction surface in the first direction, and further comprising a second nozzle connected to the second conduit, the second nozzle being adapted to direct the water toward the friction surface in the second direction, and wherein the first nozzle is located above the roof and the second nozzle is located below the roof.

37. The water fountain system of claim 1, further comprising a lighting system for displaying lights, and further comprising a sound system for creating sounds, and further comprising a control system for operating the lighting system and the sound system, the control system being coupled to the valve and adapted to activate the lighting system and the sound system when the valve is adjusted.

38. The water fountain system of claim 1, further comprising a lighting system for displaying lights, and further comprising a control system for operating the lighting system, the control system being coupled to the valve and adapted to activate the lighting system when the valve is adjusted.

39. The water fountain system of claim 1, further comprising a sound system for creating sounds, and further comprising a control system for operating the sound system, the control system being coupled to the valve and adapted to activate the sound system when the valve is adjusted.

40. The water fountain system of claim 1, wherein the second rotational direction is opposite the first rotational direction.

41. The water fountain system of claim 1, wherein the second rotational direction is the same as the first rotational direction.

42. A water fountain system, comprising:

a roof having a friction surface, wherein the friction surface is located on an upper surface of the roof;

a support member adapted to be connected to the roof to support the roof such that the roof is capable of rotating during use;

a water source;

a conduit adapted to communicate with the water source during use, the conduit being positionable to direct water onto the friction surface to cause the roof to rotate during use; and a valve for controlling water flow through the conduit during use.

43. The water fountain system of claim 42, further comprising a pump connected to the conduit for forcing water through the conduit.

44. The water fountain system of claim 42, wherein the water source is a reservoir for collecting water, and wherein the support member is attached to the reservoir.

45. The water fountain system of claim 42, further comprising a nozzle connected to the end of the conduit, the nozzle being adapted to direct a jet of water toward the friction surface to rotate the roof.

46. The water fountain system of claim 42, wherein the valve is adapted to be adjusted manually from a location proximate ground level.

47. The water fountain system of claim 42, further comprising a second friction surface located on a lower surface of the roof.

48. The water fountain system of claim 42, wherein the roof further comprises an opening, and wherein the conduit extends through the opening above the roof.

49. The water fountain system of claim 42, wherein the water source is a reservoir, and wherein the support member is attached to the reservoir.

50. The water fountain system of claim 42, wherein the friction surface comprises a plurality of protrusions.

51. The water fountain system of claim 42, wherein the support member comprises a bearing for allowing the roof to rotate, and wherein the roof comprises a bottom surface and a lip extending from the bottom surface, the lip being seated within the bearing.

52. The water fountain system of claim 42, wherein the valve is located proximate the roof, and further comprising a control system for controlling the valve, the control system being operable by a participant located at ground level.

53. The water fountain system of claim 42, further comprising a lighting system for displaying lights, and further comprising a control system for operating the lighting system, the control system being coupled to the valve and adapted to activate the lighting system when the valve is adjusted.

54. The water fountain system of claim 42, further comprising a sound system for creating musical sounds, and further comprising a control system for operating the sound system, the control system being coupled to the valve and adapted to activate the sound system when the valve is adjusted.

55. The water fountain system of claim 42, wherein the friction surface comprises a plurality of ribs extending radially from a central portion of the roof, the ribs comprising a curved portion for receiving the water directed from the first conduit.

56. The water fountain system of claim 42, wherein the friction surface comprises a plurality of radially extending ribs.

57. The water fountain system of claim 42, further comprising a second rotatable roof comprising a second friction surface, the second rotatable roof being located at a different elevation than the other rotatable roof.

58. The water fountain system of claim 42, wherein the conduit is positioned to cause the roof to rotate in a first rotatable direction, and further comprising a second rotatable roof comprising a second friction surface, and further comprising a second conduit positioned to direct water at the second friction surface to cause the second roof to rotate in a second rotatable direction, and wherein the valve controls flow of water through the second conduit.

59. The water fountain system of claim 42 wherein the conduit is adapted to direct water toward the roof in a first direction to cause the roof to rotate in a first rotational direction, and wherein the conduit is adapted to direct water toward the roof in a second direction to cause the roof to rotate in a second rotational direction, wherein the second rotational direction is opposite the first rotational direction.

60. The water fountain system of claim 42, further comprising a first nozzle positioned to direct water toward the roof in a first direction to cause the roof to rotate in a first rotational direction, and further comprising a second nozzle positioned to direct water toward the roof in a second direction to cause the roof to rotate in a second rotational direction, wherein the second rotational direction is opposite the first rotational direction.

61. The water fountain system of claim 42, further comprising a lighting system for displaying lights, and further comprising a sound system for creating sounds, and further comprising a control system for operating the lighting system and the sound system, the control system being coupled to the valve and adapted to activate the lighting system and the sound system when the valve is adjusted.

62. The water fountain system of claim 42, further comprising a lighting system for displaying lights, and further comprising a control system for operating the lighting system, the control system being coupled to the valve and adapted to activate the lighting system when the valve is adjusted.

63. The water fountain system of claim 42, further comprising a sound system for creating sounds, and further comprising a control system for operating the sound system, the control system being coupled to the valve and adapted to activate the sound system when the valve is adjusted.

64. The water fountain system of claim 42, wherein the roof has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane.

65. The water fountain system of claim 42, wherein the support member has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane, and further comprising a sound system adapted to generate sound effects during use that correspond to the figure.

66. The water fountain system of claim 42, wherein the conduit comprises a nozzle for directing the water, and wherein the nozzle is directionally adjustable.

67. The water fountain system of claim 58, wherein the second rotational direction is opposite the first rotational direction.

68. The water fountain system of claim 58, wherein the second rotational direction is the same as the first rotational direction.

69. A method for operating a water fountain system, comprising:

adjusting a valve to supply water into a first conduit, the first conduit being positioned to direct the water against a rotatable roof;

directing the water from the first conduit against a friction surface of the roof, thereby causing the roof to rotate in a first rotational direction;

adjusting the valve to supply water into a second conduit, the second conduit being positioned to direct water against the rotatable roof, and directing the water from the second conduit against a friction surface of the roof, thereby causing the roof to rotate in a second rotational direction.

70. The water fountain system of claim 69, wherein the second rotational direction is opposite the first rotational direction.

71. The water fountain system of claim 69, wherein the second rotational direction is the same as the first rotational direction.

72. The method of claim 69, wherein the valve comprises a handle, and wherein adjusting the valve comprises manually adjusting the handle.

73. The method of claim 69, wherein the friction surface comprises a plurality of radially extending ribs.

74. The method of claim 69, wherein the friction surface comprises a plurality of protrusions.

75. The method of claim 69, wherein the roof comprises a bottom surface and a lip extending from the bottom surface, the lip being seated within a bearing, and wherein the lip rotates within the bearing during rotation of the roof.

76. The method of claim 69, wherein the roof comprises a bottom surface and a lip extending from the bottom surface, the lip being seated within a bushing, and wherein the lips rotates within the bushing during rotation of the roof.

77. The method of claim 69, wherein the roof has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane.

78. The method of claim 69, wherein the valve is adjusted from a location proximate ground level.

79. The method of claim 69, wherein the valve is a diverter valve, the diverter valve being connected to the first conduit and the second conduit, and further comprising passing water into one of the conduits while preventing water from entering the other conduit.

80. The method of claim 69, wherein the valve is located proximate the roof, and further comprising adjusting the valve with a control system from a location proximate ground level.

81. The method of claim 69, wherein the friction surface comprises a plurality of ribs extending radially from a central portion of the roof, the ribs comprising a curved portion, and further comprising directing the water from the first conduit to the ribs.

82. The method of claim 69, wherein the friction surface comprises a plurality of ribs extending radially from a central portion of the roof, the ribs comprising a first curved portion for receiving the water directed from the first conduit, the ribs comprising a second curved portion for receiving the water directed from the second conduit, the first curved portion and the second curved portion extending in diverging directions, and further comprising directing the water from the first conduit toward the first curved portion, and further comprising directing the water from the second conduit toward the second curved portion.

83. The method of claim 69, wherein adjusting the valve comprises operating a control system from a location proximate ground level, the control system communicating with the valve.

84. The method of claim 69, wherein the roof comprises an opening, and wherein the first conduit extends through the opening above the roof.

85. The method of claim 69, further comprising pumping the water from a water source to the valve.

86. The method of claim 69, further comprising pumping the water from a reservoir to the valve, the reservoir being located proximate ground level.

87. The method of claim 69, further comprising directing the water off of the friction surface such that the water falls from the roof in droplets into a reservoir, and further comprising recycling at least a portion of the water from the reservoir to at least one of the first and second conduits.

88. The method of claim 69, further comprising directing a jet of water through a nozzle from the first conduit toward the friction surface.

89. The method of claim 69, further comprising directing a jet of water through a nozzle from the second conduit toward the friction surface.

90. The method of claim 69, wherein directing the water from the first conduit comprises directing the water against an upper friction surface of the roof, and wherein directing the water from the second conduit directing the water against a lower friction surface of the roof.

91. The method of claim 69, wherein directing the water from the first conduit comprises directing the water against a lower friction surface of the roof, and wherein directing the water from the second conduit comprises directing the water against a lower friction surface of the roof.

92. The method of claim 69, wherein directing the water from the first conduit comprises directing the water against an upper friction surface of the roof, and wherein directing the water from the second conduit comprises directing the water against an upper friction surface of the roof.

93. The method of claim 69, further comprising activating a lighting system to display lights proximate the roof, the lighting system being automatically activated in response to the valve being adjusted.

94. The method of claim 69, further comprising activating a sound system to produce musical sounds proximate the roof, the sound system being automatically activated in response to the valve being adjusted.

95. The method of claim 69, further comprising activating a sound system to produce sounds proximate the roof, and further comprising activating a light system to display lights proximate the roof, the sound system and the light system being automatically activated in response to the valve being adjusted.

96. The method of claim 69, wherein the support member has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane, and further comprising generating sound effects that correspond to the figure.

97. The method of claim 69, wherein the first conduit comprises a first nozzle for directing the water, and wherein the second conduit comprises a second nozzle for directing the water, and further comprising directionally adjusting the nozzles.

98. A method for operating a water fountain system, comprising:

adjusting a valve to supply water into a conduit, the conduit being positioned to direct the water onto a roof, the roof comprising a central portion and an upper surface, the upper surface comprising a friction surface, wherein the roof is rotatable about an axis extending into the central portion; and directing the water from the conduit onto the friction surface of the roof, thereby causing the roof to rotate about the axis, the friction surface comprising a protrusion providing a contact surface for the water.

99. The method of claim 98, wherein the valve comprises a handle, and wherein adjusting the valve comprises manually adjusting the handle.

100. The method of claim 98, wherein adjusting the valve is performed from a location proximate ground level.

101. The method of claim 98, wherein adjusting the valve comprises operating a control system from a location proximate ground level, the control system communicating with the valve.

102. The method of claim 98, further comprising pumping the water from a water source to the valve.

103. The method of claim 98, further comprising pumping the water from a reservoir to the valve, the reservoir being located proximate ground level.

104. The method of claim 98, further comprising directing the water off of the friction surface such that the water falls from the roof in droplets into a reservoir, and further comprising recycling at least a portion of the water from the reservoir to at least one of the first and second conduits.

105. The method of claim 98, further comprising directing a jet of water from a nozzle against the friction surface.

106. The method of claim 98, further comprising directing the water against an upper friction surface of the roof.

107. The method of claim 98, further comprising directing the water against a lower friction surface of the roof.

108. The method of claim 98, wherein the friction surface comprises a plurality of radially extending ribs, and wherein the water is directed against the ribs.

109. The method of claim 98, wherein the friction surface comprises a plurality of protrusions, and wherein the water is directed against the protrusions.

110. The method of claim 98, wherein the roof comprises a bottom surface and a lip extending from the bottom surface, the lip being seated within a bearing, and further comprising rotating the lip within the bearing during rotation of the roof.

111. The method of claim 98, wherein the roof comprises a bottom surface and a lip extending from the bottom surface, the lip being seated within a bushing, and further comprising rotating the lip within the bushing during rotation of the roof.

112. The method of claim 98, wherein the roof has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane.

113. The method of claim 98, wherein the valve is located proximate the roof, and further comprising adjusting the valve with a control system from a location proximate ground level.

114. The method of claim 98, wherein the friction surface comprises a plurality of ribs extending radially from a central portion of the roof, and further comprising directing the water against the ribs.

115. The method of claim 98, wherein the roof comprises an opening, and wherein the conduit extends through the opening above the roof.

116. The method of claim 98, further comprising activating a lighting system to display lights proximate the roof, the lighting system being automatically activated in response to the valve being adjusted.

117. The method of claim 98, further comprising activating a sound system to produce sounds proximate the roof, the sound system being automatically activated in response to the valve being adjusted.

118. A water fountain system, comprising:

a roof comprising a friction surface and an opening;

a support member configured to be coupled to the roof to support the roof such that the roof is capable of rotating during use;

a water source;

a conduit adapted to communicate with the water source during use, the conduit being positionable to direct water onto the friction surface to cause the roof to rotate during use, wherein the conduit extends through the opening above the roof; and a valve for controlling water flow through the conduit during use.

119. The water fountain system of claim 118, further comprising a nozzle connected to the conduit.

120. The water fountain system of claim 118, further comprising a nozzle connected to the conduit, wherein the nozzle is directionally adjustable during use.

121. The water fountain system of claim 118, wherein the support member comprises a bearing for allowing the roof to rotate during use, and wherein the roof comprises a bottom surface and a lip extending from the bottom surface, the lip being coupled to the bearing.

122. The water fountain system of claim 118, wherein the support member comprises a bushing for allowing the roof to rotate during use, and wherein the roof comprises a bottom surface and a lip extending from the bottom surface, the lip being coupled to the bushing.

123. The water fountain system of claim 118, wherein the conduit is mounted to an exterior surface of the support member.

124. The water fountain system of claim 118, wherein the conduit is disposed within the support member.

125. The water fountain system of claim 118, further comprising a lighting system for displaying lights, and further comprising a control system for operating the lighting system during use.

126. The water fountain system of claim 118, further comprising a sound system for creating musical sounds, and further comprising a control system for operating the sound system during use.

127. The water fountain system of claim 118, wherein the roof has a shape that resembles a figure selected from the group consisting of a square, a circle, a triangle, a cone, a sphere, an umbrella, a pyramid, an animal, an insect, a plant, a dinosaur, a space ship, an inner tube, a boat, an auto, and an airplane.

128. The water fountain system of claim 118, wherein the friction surface comprises a plurality of protrusions extending radially from a central portion of the roof, the protrusions comprising a curved portion for receiving the water directed from the conduit during use.

129. The water fountain system of claim 118, wherein the friction surface is located on an upper surface of the roof.

130. The water fountain system of claim 118, wherein the friction surface is located on a lower surface of the roof.

131. The water fountain system of claim 118, wherein the roof comprises an upper surface and a lower surface, and wherein the friction surface is located on both the upper surface and the lower surface.

132. The water fountain system of claim 118, wherein the water source is a reservoir for collecting water; and wherein the roof is configured such that water falls from the roof into the reservoir during use.

133. The water fountain system of claim 118, wherein the valve is adapted to be adjusted manually from a location proximate ground level.

134. The water fountain system of claim 118, further comprising a pump coupled to the conduit for forcing water through the conduit during use.

135. The water fountain system of claim 118, wherein the water source is a reservoir, and wherein the support member is positioned within the reservoir.

136. The water fountain system of claim 118, further comprising a lighting system for displaying lights, and further comprising a control system for operating the lighting system, the control system being coupled to the valve and configured to activate the lighting system when the valve is operated during use.

137. The water fountain system of claim 118, further comprising a sound system for creating musical sounds, and further comprising a control system for operating the sound system, the control system being coupled to the valve and configured to activate the sound system when the valve is operated during use.

138. The water fountain system of claim 118, further comprising a lighting system for displaying lights, and further comprising a sound system for creating sounds, and further comprising a control system for operating the lighting system and the sound system, the control system being coupled to the valve and adapted to activate the lighting system and the sound system when the valve is adjusted.

139. The water fountain system of claim 118, further comprising a second rotatable roof comprising a second friction surface, and further comprising a second conduit positioned to direct water at the second friction surface to cause the second roof to rotate, and wherein the valve controls flow of water through the second conduit.

140. The water fountain system of claim 125, wherein the conduit is positioned to cause the roof to rotate in a first direction, and further comprising a second rotatable roof comprising a second friction surface, and further comprising a second conduit positioned to direct water at the second friction surface to cause the second roof to rotate in a second direction, the second direction being opposite the first direction, and wherein the valve controls flow of water through the second conduit.

141. The water fountain system of claim 125, wherein the conduit is adapted to direct water toward the roof in a first direction to cause the roof to rotate in a first rotational direction, and wherein the conduit is adapted to direct water toward the roof in a second direction to cause the roof to rotate in a second rotational direction, wherein the second rotational direction is opposite the first rotational direction.

142. The water fountain system of claim 125, further comprising a first nozzle positioned to direct water toward the roof in a first direction to cause the roof to rotate in a first rotational direction, and further comprising a second nozzle positioned to direct water toward the roof in a second direction to cause the roof to rotate in a second rotational direction, wherein the second rotational direction is opposite the first rotational direction.

143. The water fountain system of claim 125, wherein the support member is configured to be the conduit.

144. A water fountain system, comprising:

a roof comprising a friction surface;

a support member configured to be coupled to the roof to support the roof such that the roof is capable of rotating during use, wherein the support member comprises a rotation member coupling the roof to the support member, the rotation member being configured to allow the roof to rotate about the support member during use;

a water source;

a conduit adapted to communicate with the water source during use, the conduit being positionable to direct water onto the friction surface to cause the roof to rotate during use; and a valve for controlling water flow through the conduit during use.

145. The water fountain system of claim 144, wherein the rotation member comprises a bearing for allowing the roof to rotate during use, and wherein the roof comprises a bottom surface and a lip extending from the bottom surface, the lip being seated within the bearing.

146. The water fountain system of claim 144, wherein the rotation member comprises a bushing for allowing the roof to rotate during use, and wherein the roof comprises a bottom surface and a lip extending from the bottom surface, the lip being coupled to the bushing.

147. The water fountain system of claim 144, further comprising a nozzle connected to the conduit.

148. The water fountain system of claim 144, further comprising a nozzle connected to the conduit, wherein the nozzle is directionally adjustable during use.

149. The water fountain system of claim 144, wherein the conduit is mounted to an exterior surface of the support member.

150. The water fountain system of claim 144, wherein the conduit is disposed within the support member.

151. The water fountain system of claim 144, further comprising a lighting system for displaying lights, and further comprising a control system for operating the lighting system during use.

152. The water fountain system of claim 144, further comprising a sound system for creating musical sounds, and further comprising a control system for operating the sound system during use.

153. The water fountain system of claim 144, wherein the roof has a shape that resembles a figure selected from the group consisting of a square, a circle, a triangle, a cone, a sphere, an umbrella, a pyramid, an animal, an insect, a plant, a dinosaur, a space ship, an inner tube, a boat, an auto, and an airplane.

154. The water fountain system of claim 144, wherein the friction surface comprises a plurality of protrusions extending radially from a central portion of the roof, the protrusions comprising a curved portion for receiving the water directed from the conduit during use.

155. The water fountain system of claim 144, wherein the friction surface is located on an upper surface of the roof.

156. The water fountain system of claim 144, wherein the friction surface is located on a lower surface of the roof.

157. The water fountain system of claim 144, wherein the roof comprises an upper surface and a lower surface, and wherein the friction surface is located on both the upper surface and the lower surface.

158. The water fountain system of claim 144, wherein the water source is a reservoir for collecting water; and wherein the roof is configured such that water falls from the roof into the reservoir during use.

159. The water fountain system of claim 144, wherein the valve is adapted to be adjusted manually from a location proximate ground level.

160. The water fountain system of claim 144, further comprising a pump coupled to the conduit for forcing water through the conduit during use.

161. The water fountain system of claim 144, wherein the water source is a reservoir, and wherein the support member is positioned within the reservoir.

162. The water fountain system of claim 144, further comprising a lighting system for displaying lights, and further comprising a control system for operating the lighting system, the control system being coupled to the valve and configured to activate the lighting system when the valve is operated during use.

163. The water fountain system of claim 144, further comprising a sound system for creating musical sounds, and further comprising a control system for operating the sound system, the control system being coupled to the valve and configured to activate the sound system when the valve is operated during use.

164. The water fountain system of claim 144, further comprising a lighting system for displaying lights, and further comprising a sound system for creating sounds, and further comprising a control system for operating the lighting system and the sound system, the control system being coupled to the valve and adapted to activate the lighting system and the sound system when the valve is adjusted.

165. The water fountain system of claim 144, wherein the conduit is positioned to cause the roof to rotate, and further comprising a second rotatable roof comprising a second friction surface, and further comprising a second conduit positioned to direct water at the second friction surface to cause the second roof to rotate, and wherein the valve controls flow of water through the second conduit.

166. The water fountain system of claim 144, further comprising a second rotatable roof comprising a second friction surface, and further comprising a second conduit positioned to direct water at the second friction surface to cause the second roof to rotate, and wherein the valve controls flow of water through the second conduit.

167. The water fountain system of claim 144, wherein the conduit is positioned to cause the roof to rotate in a first direction, and further comprising a second rotatable roof comprising a second friction surface, and further comprising a second conduit positioned to direct water at the second friction surface to cause the second roof to rotate in a second direction, the second direction being opposite the first direction, and wherein the valve controls flow of water through the second conduit.

168. The water fountain system of claim 144, wherein the conduit is adapted to direct water toward the roof in a first direction to cause the roof to rotate in a first rotational direction, and wherein the conduit is adapted to direct water toward the roof in a second direction to cause the roof to rotate in a second rotational direction, the second direction being opposite the first direction.

169. The water fountain system of claim 144, further comprising a first nozzle positioned to direct water toward the roof in a first direction to cause the roof to rotate in a first rotational direction, and further comprising a second nozzle positioned to direct water toward the roof in a second direction to cause the roof to rotate in a second rotational direction, the second direction being opposite the first direction.

170. The water fountain system of claim 144, wherein the support member is configured to be the conduit.

171. A method for operating a water fountain system, comprising:

adjusting a valve to supply water into a conduit, the conduit being positioned to direct the water onto a roof, the roof comprising a central portion and an opening, wherein the roof is rotatable about an axis extending into the central portion, and wherein the conduit extends through the opening above the roof; and directing the water from the conduit onto a friction surface of the roof, thereby causing the roof to rotate about the axis, the friction surface comprising a protrusion providing a contact surface for the water.

172. The method of claim 171, wherein the valve comprises a handle, and wherein adjusting the valve comprises manually adjusting the handle.

173. The method of claim 171, wherein adjusting the valve is performed from a location proximate ground level.

174. The method of claim 171, wherein adjusting the valve comprises operating a control system from a location proximate ground level, the control system communicating with the valve.

175. The method of claim 171, further comprising pumping the water from a water source to the valve.

176. The method of claim 171, further comprising pumping the water from a reservoir to the valve, the reservoir being located proximate ground level.

177. The method of claim 171, further comprising activating a sound system to produce sounds proximate the roof, the sound system being automatically activated in response to the valve being adjusted.

178. The method of claim 171, further comprising directing the water off of the friction surface such that the water falls from the roof in droplets into a reservoir, and further comprising recycling at least a portion of the water from the reservoir to at least one of the first and second conduits.

179. The method of claim 171, further comprising directing a jet of water from a nozzle against the friction surface.

180. The method of claim 171, further comprising directing the water against an upper friction surface of the roof.

181. The method of claim 171, further comprising directing the water against a lower friction surface of the roof.

182. The method of claim 171, wherein the friction surface comprises a plurality of radially extending ribs, and wherein the water is directed against the ribs.

183. The method of claim 171, wherein the friction surface comprises a plurality of protrusions, and wherein the water is directed against the protrusions.

184. The method of claim 171, wherein the roof comprises a bottom surface and a lip extending from the bottom surface, the lip being seated within a bearing, and further comprising rotating the lip within the bearing during rotation of the roof.

185. The method of claim 171, wherein the roof comprises a bottom surface and a lip extending from the bottom surface, the lip being seated within a bushing, and further comprising rotating the lip within the bushing during rotation of the roof.

186. The method of claim 171, wherein the roof has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane.

187. The method of claim 171, wherein the valve is located proximate the roof, and further comprising adjusting the valve with a control system from a location proximate ground level.

188. The method of claim 171, wherein the friction surface comprises a plurality of ribs extending radially from a central portion of the roof, and further comprising directing the water against the ribs.

189. The method of claim 171, further comprising activating a lighting system to display lights proximate the roof, the lighting system being automatically activated in response to the valve being adjusted.

190. A method for operating a water fountain system, comprising:

adjusting a valve to supply water into a conduit, the conduit being positioned to direct the water onto a roof, the roof comprising a central portion and an opening, wherein the roof is supported by a support member extending into the central portion, wherein the support member comprises a rotation member coupling the roof to the support member, the rotation member configured to allow the roof to rotate about the support member; and directing the water from the conduit onto a friction surface of the roof, thereby causing the roof to rotate about the axis, the friction surface comprising a protrusion providing a contact surface for the water.

191. The method of claim 190, further comprising activating a sound system to produce sounds proximate the roof, the sound system being automatically activated in response to the valve being adjusted.

192. The method of claim 190, wherein the support member comprises a bearing, and wherein the roof further comprises a bottom surface and a lip extending from the bottom surface, the lip being seated within the bearing.

193. The method of claim 190, wherein the support member comprises a bushing, and wherein the roof further comprises a bottom surface and a lip extending from the bottom surface, the lip being coupled to the bushing.

194. The method of claim 190, wherein the valve comprises a handle, and wherein adjusting the valve comprises manually adjusting the handle.

195. The method of claim 190, wherein adjusting the valve is performed from a location proximate ground level.

196. The method of claim 190, wherein adjusting the valve comprises operating a control system from a location proximate ground level, the control system communicating with the valve.

197. The method of claim 190, further comprising pumping the water from a water source to the valve.

198. The method of claim 190, further comprising pumping the water from a reservoir to the valve, the reservoir being located proximate ground level.

199. The method of claim 190, further comprising directing the water off of the friction surface such that the water falls from the roof in droplets into a reservoir, and further comprising recycling at least a portion of the water from the reservoir to at least one of the first and second conduits.

200. The method of claim 190, further comprising directing a jet of water from a nozzle against the friction surface.

201. The method of claim 190, further comprising directing the water against an upper friction surface of the roof.

202. The method of claim 190, further comprising directing the water against a lower friction surface of the roof.

203. The method of claim 190, wherein the friction surface comprises a plurality of radially extending ribs, and wherein the water is directed against the ribs.

204. The method of claim 190, wherein the friction surface comprises a plurality of protrusions, and wherein the water is directed against the protrusions.

205. The method of claim 190, wherein the roof comprises a bottom surface and a lip extending from the bottom surface, the lip being seated within a bearing, and further comprising rotating the lip within the bearing during rotation of the roof.

206. The method of claim 190, wherein the roof comprises a bottom surface and a lip extending from the bottom surface, the lip being seated within a bushing, and further comprising rotating the lip within the bushing during rotation of the roof.

207. The method of claim 190, wherein the roof has a shape that resembles a figure selected from the group consisting of: a square, a circle, a triangle, a cone, a sphere, an umbrella, a pyramid, an animal, an insect, a plant, a dinosaur, a space ship, an inner tube, a boat, an auto, and an airplane.

208. The method of claim 190, wherein the valve is located proximate the roof, and further comprising adjusting the valve with a control system from a location proximate ground level.

209. The method of claim 190, wherein the friction surface comprises a plurality of ribs extending radially from a central portion of the roof, and further comprising directing the water against the ribs.

210. The method of claim 190, further comprising activating a lighting system to display lights proximate the roof, the lighting system being automatically activated in response to the valve being adjusted.

* * * * *